US010330398B2

(12) United States Patent
Cui et al.

(10) Patent No.: US 10,330,398 B2
(45) Date of Patent: Jun. 25, 2019

(54) HEAT EXCHANGER

(71) Applicant: Hangzhou Sanhua Research Institute Co., Ltd., Hangzhou, Zhejiang (CN)

(72) Inventors: Kai Cui, Hangzhou (CN); Zhou Lv, Hangzhou (CN); Linfeng Zhu, Hangzhou (CN)

(73) Assignee: Hangzhou Sanhua Research Institute Co., Ltd., Hangzhou, Zhejiang (CN)

( * ) Notice: Subject to any disclaimer, the term of this patent is extended or adjusted under 35 U.S.C. 154(b) by 260 days.

(21) Appl. No.: 14/622,710

(22) Filed: Feb. 13, 2015

(65) Prior Publication Data

US 2015/0241129 A1 Aug. 27, 2015

(30) Foreign Application Priority Data

Feb. 27, 2014 (CN) ..... 2014 1 0068622

(51) Int. Cl.
*F28F 9/02* (2006.01)
*F28D 1/053* (2006.01)
(Continued)

(52) U.S. Cl.
CPC ..... *F28F 9/0207* (2013.01); *F28D 1/05391* (2013.01); *F28F 9/028* (2013.01);
(Continued)

(58) Field of Classification Search
CPC combination set(s) only.
See application file for complete search history.

(56) References Cited

U.S. PATENT DOCUMENTS 4,809,518 A * 3/1989 Murayama ..... F25B 39/022 62/225
6,397,938 B1 * 6/2002 Nishishita ..... F28D 15/043 122/366
(Continued)

FOREIGN PATENT DOCUMENTS

CN 1292484 A 4/2001
CN 101216209 A 7/2008
(Continued)

OTHER PUBLICATIONS

JP 3395038 B2 machine translation.*
(Continued)

*Primary Examiner* — Keith M Raymond
*Assistant Examiner* — Gordon A Jones
(74) *Attorney, Agent, or Firm* — Wolf, Greenfield & Sacks, P.C.

(57) ABSTRACT

A heat exchanger includes a first header pipe, a second header pipe, a third header pipe, a fourth header pipe and a plurality of flat tubes, the first header pipe is provided with a first space and a second space and a communicating passage for communicating the first space with the second space; when refrigerant flows from the first space of the first header pipe to the second header pipe along the flat tubes, a part of the refrigerant passes through the communicating passage and directly enters into the second space of the first header pipe, thus an overall flow resistance of the heat exchanger may be decreased to some extent. Besides, the flow quantity of the refrigerant in the third flow path is constant, however fluid state parameters may change, which may greatly improve the heat exchange capacity of the third flow path, thereby improving the heat exchange performance of the heat exchanger on the whole.

10 Claims, 11 Drawing Sheets

(51) Int. Cl.

| | |
|---|---|
| *F28F 1/12* | (2006.01) |
| *F28D 21/00* | (2006.01) |
| *F25B 39/02* | (2006.01) |

(52) U.S. Cl.

CPC ..... *F25B 39/02* (2013.01); *F28D 2021/0071* (2013.01); *F28F 1/126* (2013.01); *F28F 2260/02* (2013.01)

(56) References Cited

U.S. PATENT DOCUMENTS

| | | | | |
|---|---|---|---|---|
| 6,449,979 | B1 * | 9/2002 | Nagasawa | F28D 1/0391 62/503 |
| 8,701,750 | B2 * | 4/2014 | Oh | F28D 1/05391 165/174 |
| 9,366,463 | B2 * | 6/2016 | Higashiyama | F25B 39/02 |
| 9,803,928 | B2 * | 10/2017 | Takagi | F28F 9/0207 |
| 2002/0000309 | A1 * | 1/2002 | Kim | F28D 1/0341 165/100 |
| 2009/0283247 | A1 * | 11/2009 | Aung | F25B 39/022 165/178 |
| 2010/0243223 | A1 * | 9/2010 | Lim | F25B 39/022 165/173 |
| 2011/0139420 | A1 | 6/2011 | Wang | |
| 2011/0220318 | A1 | 9/2011 | Kopchick et al. | |
| 2015/0053383 | A1 * | 2/2015 | Citti | F28F 9/0212 165/173 |
| 2016/0102893 | A1 * | 4/2016 | Ishizaka | F25B 39/02 62/524 |

FOREIGN PATENT DOCUMENTS

| | | | | |
|---|---|---|---|---|
| CN | 101419002 | A | 4/2009 | |
| CN | 101701756 | A | 5/2010 | |
| CN | 101936670 | A | 1/2011 | |
| CN | 102914100 | A | 2/2013 | |
| DE | 102013203222 | A1 | 8/2014 | |
| EP | 0802383 | A2 * | 10/1997 | F28D 1/05341 |
| EP | 1712868 | A2 | 10/2006 | |
| EP | 2372289 | A2 | 10/2011 | |
| FR | 2825793 | A1 * | 12/2002 | F28D 1/0341 |
| FR | 2988825 | A1 | 10/2013 | |
| JP | 2001074388 | A | 3/2001 | |
| JP | 2011074388 | A | 3/2001 | |
| JP | 3395038 | B2 * | 4/2003 | F28B 1/0341 |
| JP | 2010151381 | A * | 7/2010 | F25B 39/02 |
| WO | WO 2014/131756 | A1 | 9/2014 | |

OTHER PUBLICATIONS

FR 2825793 A1 machine translation.*

Extended European Search Report dated Jul. 14, 2015 from European Application No. 15155072.

Extended European Search Report dated Jun. 22, 2015 and the European Search Opinion from potentially related European Application No. 15155074.

Chinese Office Action for Application No. CN 201410068622.8 dated Apr. 2, 2018.

* cited by examiner

HEAT EXCHANGER

This application claims the benefit of priority to Chinese Patent Application No. 201410068622.8 titled "HEAT EXCHANGER", filed with the Chinese State Intellectual Property Office on Feb. 27, 2014, the entire disclosure of which is incorporated herein by reference.

TECHNICAL FIELD

The present application relates to a heat exchanger, which belongs to the field of refrigeration technique, such as air conditioners and etc.

BACKGROUND

In recent decades, the air-conditioning industry has been developed rapidly, thus a heat exchanger, as one of the main components of the air conditioner, is also required to be improved to optimize the design according to the market requirements. A parallel flow heat exchanger has characteristics, such as a high cooling efficiency, a small size and a light weight, thus can meet the market requirements quite well, and it has been increasingly applied in various kinds of air conditioning systems in recent years.

A parallel flow heat exchanger mainly includes micro-channel flat tubes, fins and header pipes. The header pipes are provided at two ends of the micro-channel flat tubes to distribute and collect refrigerant. The corrugated or louvered fins are provided between adjacent micro-channel flat tubes to improve the heat exchange efficiency between the heat exchanger and the air. A baffle is provided inside the header pipe to divide all of the micro-channel flat tubes into a plurality of flow paths, and with reasonable distribution of flat tubes in each flow path, a better heat exchange efficiency may be realized.

FIGS. 1 to 4 are schematic views of a heat exchanger to be improved which is known by the inventors, a heat exchanger 100' includes a first header pipe 1', a second header pipe 2', a third header pipe 3', a fourth header pipe 4', a plurality of flat tubes 5', and fins 6' welded between every two adjacent flat tubes 5'. The first header pipe 1' includes a first baffle 10' located inside the first header pipe 1' to separate the first header pipe 1' into a first space 11' and a second space 12'. The first baffle 10' is an imperforate baffle, thus the first space 11' is not in direct communication with the second space 12'. Similarly, the third header pipe 3' includes a second baffle 30' located inside the third header pipe 3' to separate the third header pipe 3' into a third space 31' and a fourth space 32'. The second baffle 30' is also an imperforate baffle, thus the third space 31' and the fourth space 32' are not in direct communication with each other.

Reference is made to FIGS. 3 and 4. Arrows in the figures indicate flow directions of the refrigerant. The flow of the refrigerant in the heat exchanger 100' substantially includes four flow paths.

In a first flow path, the refrigerant enters into the first space 11' of the first header pipe 1' from a refrigerant inlet, and due to the separation of the first baffle 10', the refrigerant flows along corresponding flat tubes 5' to the second header pipe 2' in the direction of the downward arrows.

In a second flow path, the refrigerant entering into the second header pipe 2' flows along corresponding flat tubes 5' to the second space 12' of the first header pipe 1' in the direction of the upward arrows.

In a third flow path, due to the communication between the second space 12' of the first header pipe 1' and the third space 31' of the third header pipe 3', and the separation of the second baffle 30, the refrigerant passing through the first header pipe 1' flows along corresponding flat tubes 5' to enter into the fourth header pipe 4' in the direction of the downward arrows.

In a fourth flow path, the refrigerant entering into the fourth header pipe 4' flows along corresponding flat tubes 5' to the fourth space 32' of the third header pipe 3' in the direction of the upward arrows, and finally is discharged via a refrigerant outlet.

Referring to FIG. 5, with intensive research and creative efforts, the inventors have found that the first flow path to the fourth flow path have different heat exchange performances, wherein the first flow path, the second flow path, the fourth flow path have a low heat exchange performance while the third flow path have a heat exchange performance much better than that of other flow paths.

Therefore, an urgent technical issue to be addressed in this technical field is to improve the heat exchange performance of the heat exchanger on the whole according to heat exchange performances of different flow paths.

SUMMARY

An object of the present application is to provide a heat exchanger with a better overall heat exchange performance.

For realizing the above object, the following technical solutions are provided according to the present application. A heat exchanger includes a first header pipe, a second header pipe, a third header pipe, a fourth header pipe and a plurality of flat tubes, one part of the flat tubes connect the first header pipe to the second header pipe, another part of the flat tubes connect the third header pipe to the fourth header pipe, the first header pipe includes a first space and a second space, wherein a flow path, that the refrigerant flows from the first space of the first header pipe to the second header pipe along corresponding flat tubes, is defined as a first flow path; a flow path, that the refrigerant flows from the second header pipe to the second space of the first header pipe along corresponding flat tubes, is defined as a second flow path; and a flow path, that the refrigerant passing through the second space flows from the third header pipe to the fourth header pipe along corresponding flat tubes, is defined as a third flow path; and wherein the heat exchanger also includes a communicating passage for communicating the first space with the second space, and when the refrigerant flows from the first space of the first header pipe to the second header pipe along the flat tubes, a part of the refrigerant passes through the communicating passage to directly enter into the second space of the first header pipe.

For realizing the above object, a heat exchanger is further provided according to the present application, which includes a first header pipe, a second header pipe, a third header pipe, a fourth header pipe and a plurality of flat tubes, one part of the flat tubes connect the first header pipe to the second header pipe, another part of the flat tubes connect the third header pipe to the fourth header pipe, the first header pipe includes a first space and a second space, the first space is in communication with the second header pipe through corresponding flat tubes, the second header pipe is in communication with the second space of the first header pipe through corresponding flat tubes, and the second space is in communication with the third header pipe, and the heat exchanger also includes a communicating passage for communicating the first space with the second space.

Compared with the technique to be improved, in the first flow path of the present application, a small part of the refrigerant directly enters into the second space of the first header pipe through the communicating passage, skipping the first flow path and the second flow path, thus the flow quantity of the refrigerant in the first flow path and the second flow path is decreased and the flow resistance is greatly decreased, thus the overall flow resistance of the heat exchanger of the present application may be reduced to some extent. Besides, the flow quantity of the refrigerant in the third flow path is constant, however fluid state parameters may change, and the change of the fluid state parameters may greatly improve the heat exchange capacity of the third flow path, thereby improving the heat exchange performance of the heat exchanger on the whole.

DETAILED DESCRIPTION

Figure 1:
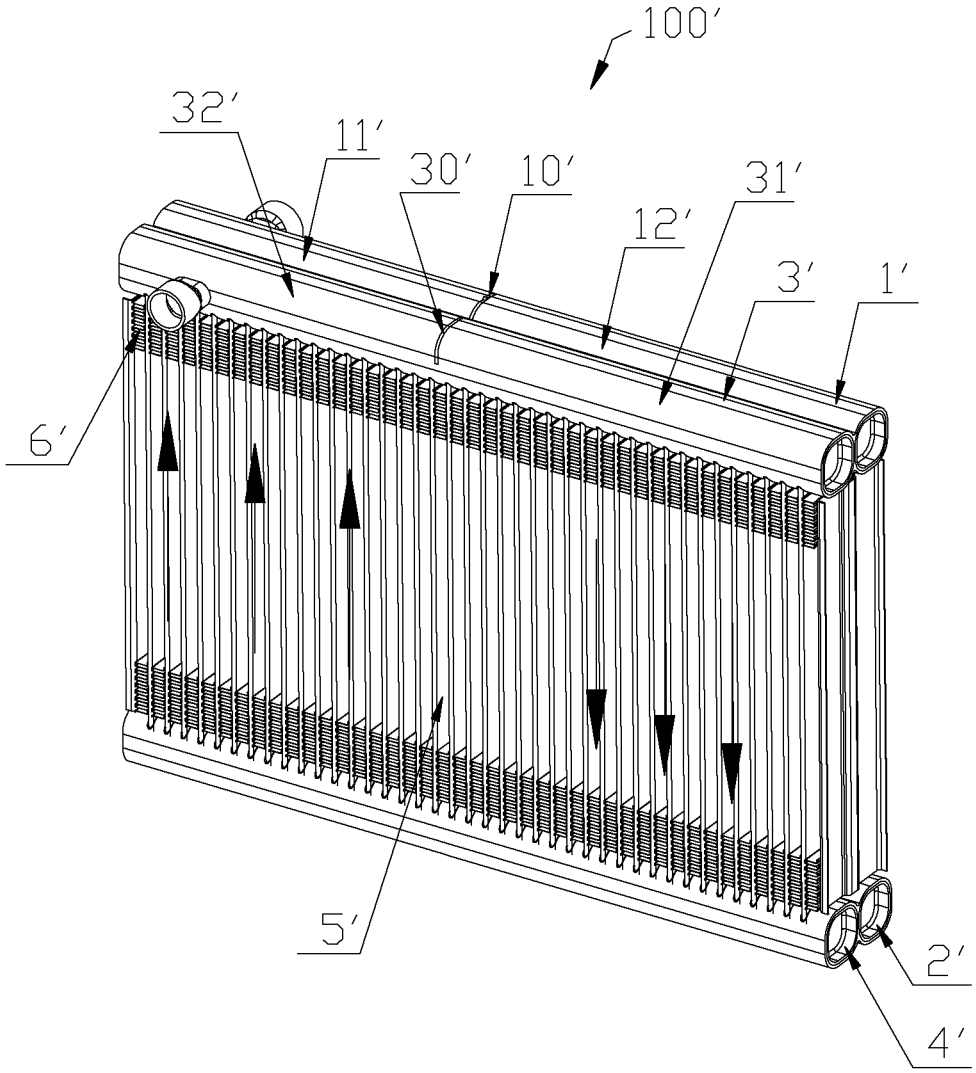
FIG. 1 is a perspective view of a heat exchanger to be improved which is known to the inventors.
Figure 2:
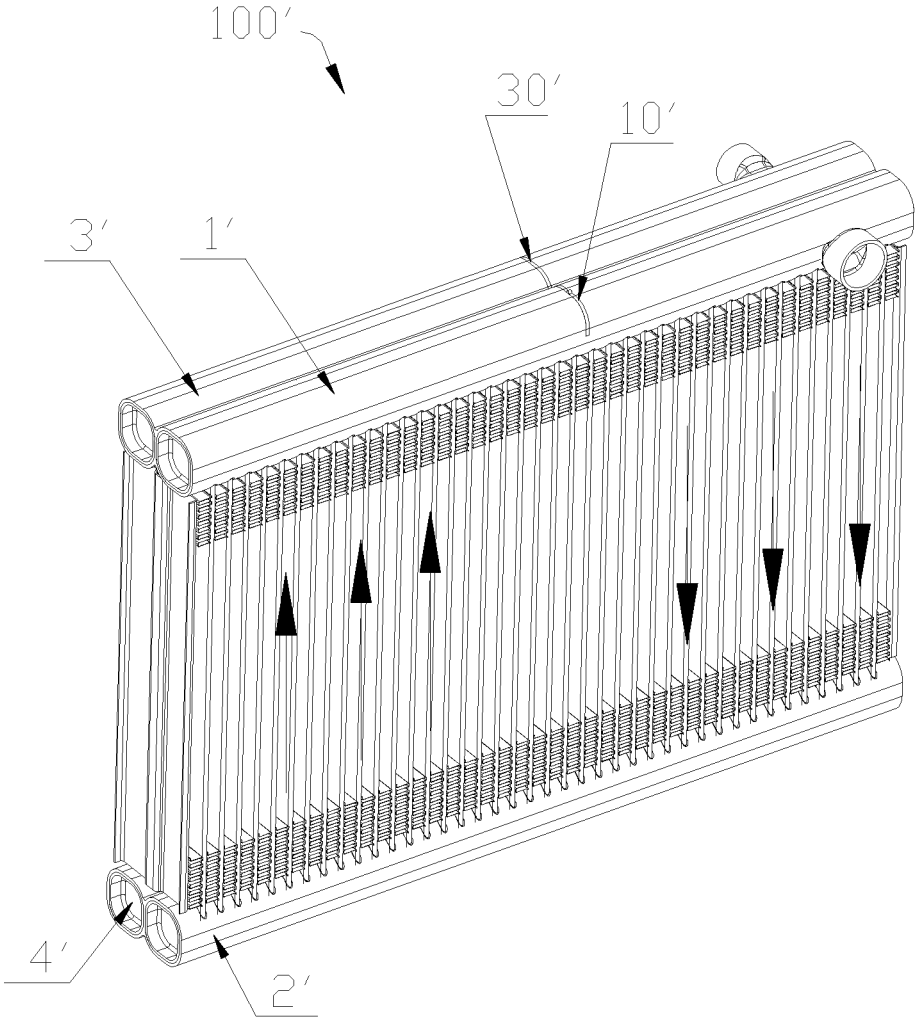
FIG. 2 is a perspective view of the heat exchanger in FIG. 1 seen from another angle.
Figure 3:
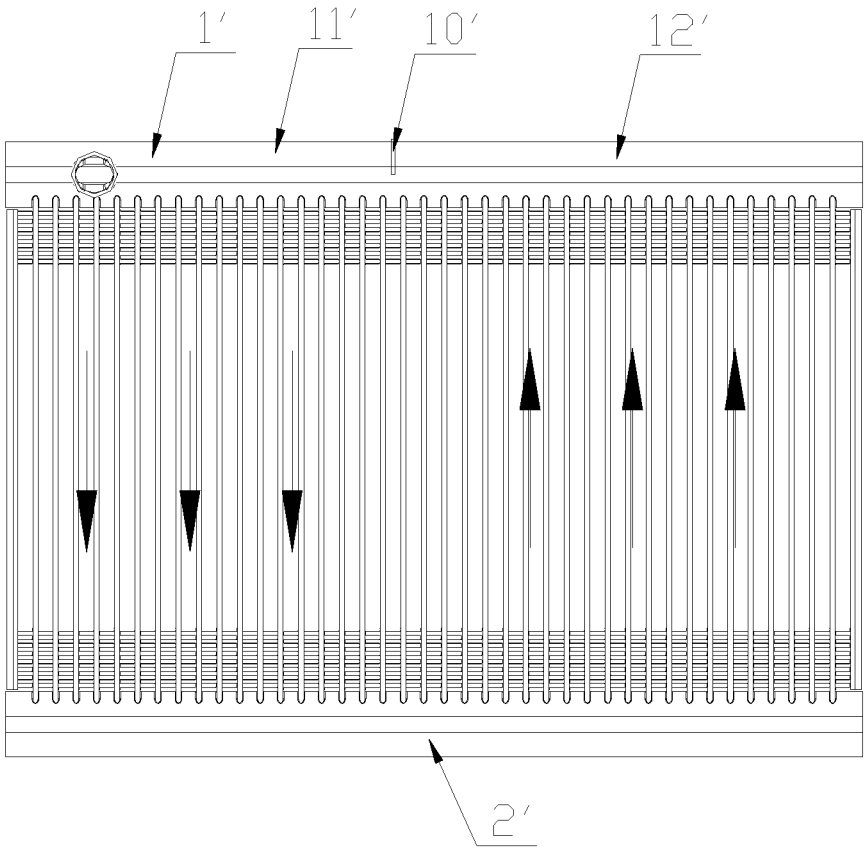
FIG. 3 is a schematic view showing a first flow path and a second flow path of the heat exchanger in FIG. 1.
Figure 4:
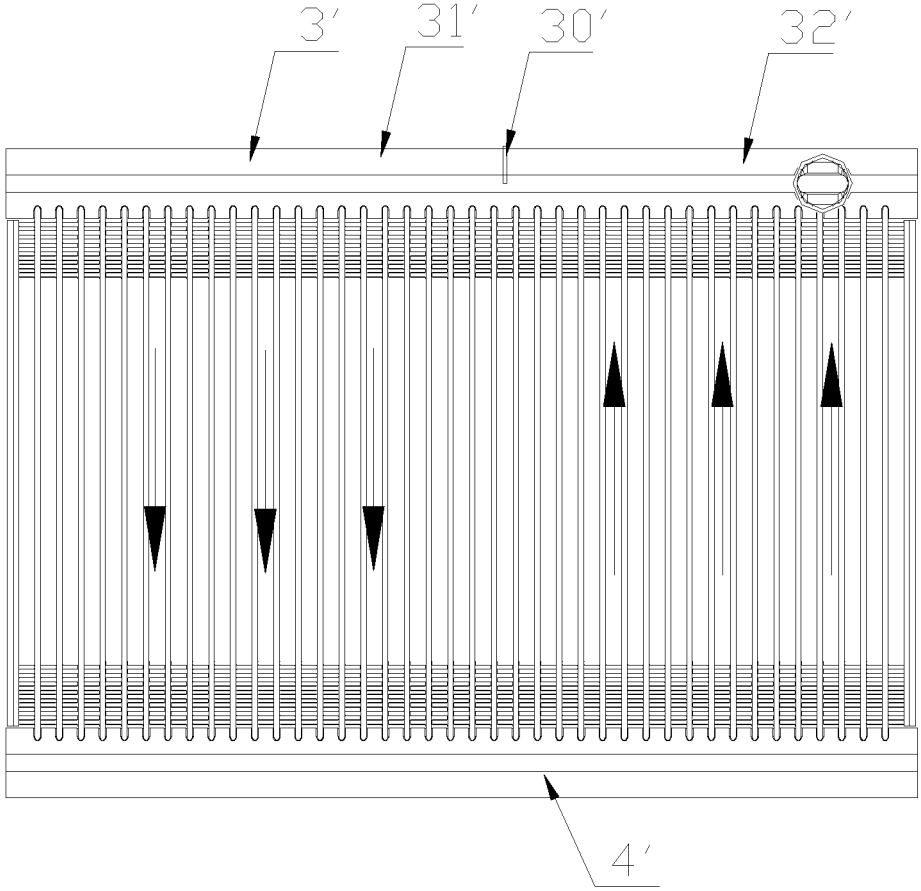
FIG. 4 is schematic view showing a third flow path and a fourth flow path of the heat exchanger in FIG. 1.
Figure 5:
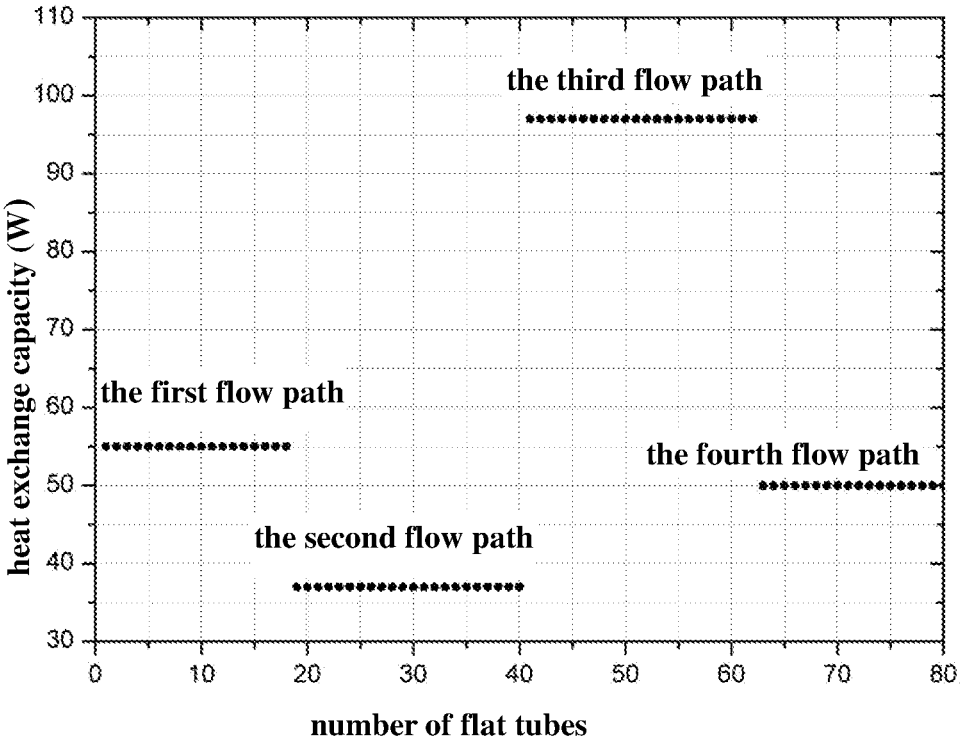
FIG. 5 is a schematic view showing the analysis of heat exchange capabilities of the first flow path to the fourth flow path of the heat exchanger in FIG. 1.

Referring to FIGS. 6 to 10, a heat exchanger 100 is provided according to the present application, and may be applied in air conditioners, household appliances and other systems requiring the heat exchanger. In an embodiment shown in the figures of the present application, the heat exchanger 100 is a laminated micro-channel heat exchanger. The heat exchanger 100 includes a first header pipe 1, a second header pipe 2, a third header pipe 3, a fourth header pipe 4, a plurality of flat tubes 5, and fins 6 welded between every two adjacent flat tubes 5. One part of the flat tubes 5 connect the first header pipe 1 to the second header pipe 2, and another part of the flat tubes 5 connect the third header pipe 3 to the header pipe 4. In an embodiment shown in figures of the present application, each of the flat tubes 5 is a micro-channel flat tube and has two ends respectively inserted into a respective header pipe.

Figure 6:
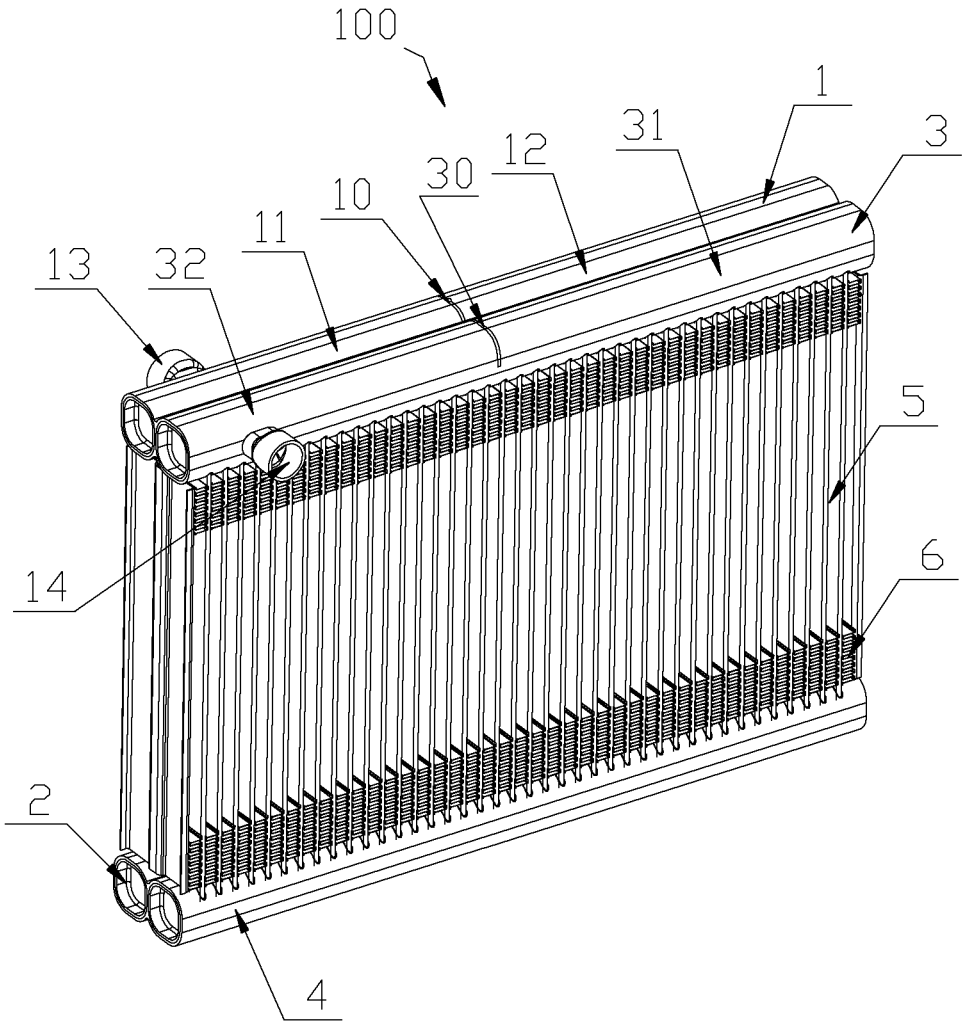
FIG. 6 is a perspective schematic view of a heat exchanger according to the present application.
Figure 7:
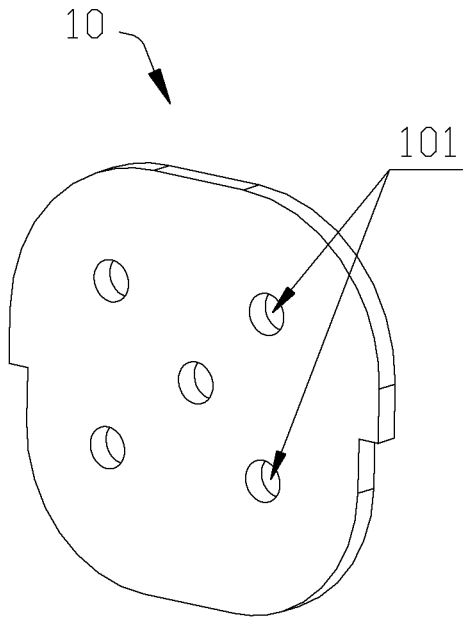
FIG. 7 is a perspective schematic view showing a first baffle arranged inside a first header pipe in FIG. 6.
Figure 9:
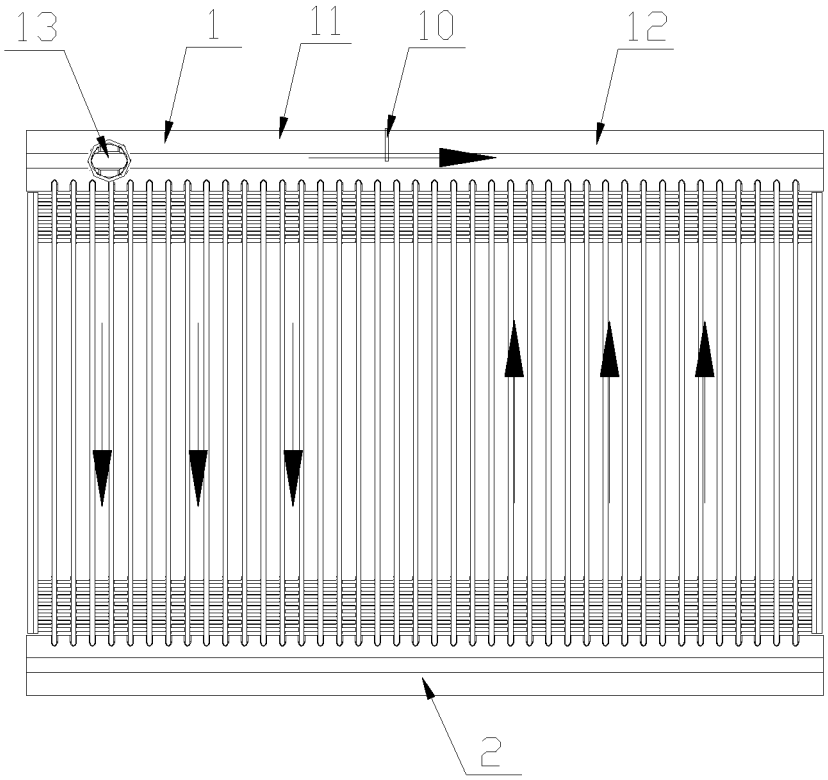
FIG. 9 is a schematic view showing a first flow path and a second flow path of the heat exchanger according to the present application.

Referring to FIGS. 6 and 9, the first header pipe 1 includes a first baffle 10 located inside the first header pipe 1 to substantially separate the first header pipe 1 into a first space 11 and a second space 12. Referring to FIG. 7, the first baffle 10 is provided with a plurality of through holes 101, and these through holes 101 are used as a communicating passage for communicating the first space 11 with the second space 12.

Of course, in other embodiments of the present application, a communicating pipe may also be provided. The communicating pipe is provided with a flow passage pipeline, and the flow passage is used as a communicating passage for communicating the first space 11 with the second space 12. In this case, the first baffle 10 in FIG. 9 may be replaced with an imperforate baffle. As shown in FIGS. 12-15, the communicating pipes 70, 71 are inserted in a baffle 70, and the flow passages formed in the communicating pipes 70, 71 are used as communicating passages for communicating the first space 11 with the second space 12. As shown in FIG. 14, the communicating pipe 71 may be a pipe with two ends extending into the first space and the second space respectively, and as shown in FIG. 15, the communicating pipe 72 may be a pipe with two ends extending into the first space 11 and the second space 12 respectively, and one of the two ends has a flange abutting against an end surface of the baffle 70.

In embodiments shown in the figures of the present application, the second header pipe 2 and the fourth header pipe 4 are both a straight-through tube, and are both not provided with any baffle. Of course, a perforated baffle or an imperforate baffle may also be provided inside the second header pipe 2 and the fourth header pipe 4 according to different flow paths.

Figure 8:
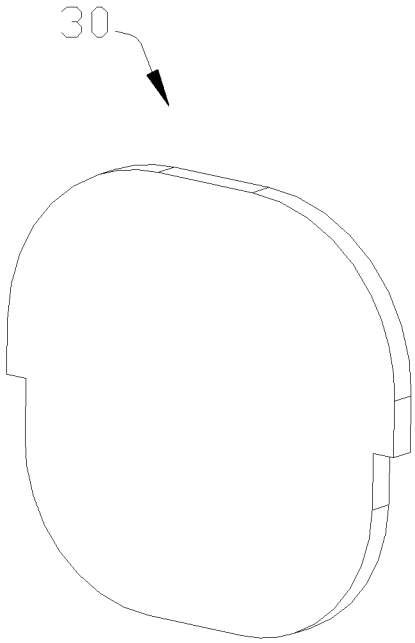
FIG. 8 is a perspective schematic view showing a second baffle arranged inside a third header pipe in FIG. 6.
Figure 10:
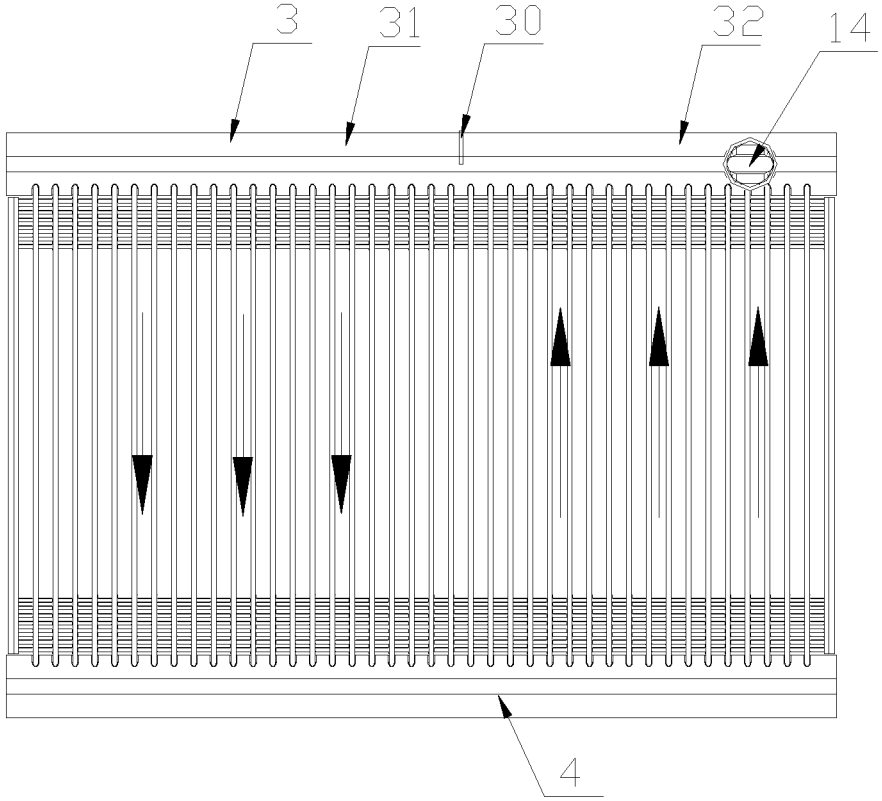
FIG. 10 is a schematic view showing a third flow path and a fourth flow path of the heat exchanger according to the present application.

Referring to FIGS. 6, 8 and 10, the third header pipe 3 includes a second baffle 30 located inside the third header pipe 3 to separate the third header pipe 3 into a third space 31 and a fourth space 32. The second baffle 30 is an imperforate baffle without through holes 101, thus the third space 31 and the fourth space 32 are not in direct communication with each other. Besides, the heat exchanger 100 also includes a refrigerant inlet 13 in communication with the first space 11 and a refrigerant outlet 14 in communication with the fourth space 32.

Referring to FIG. 6, in an embodiment shown in the figure of the present application, the first header pipe 1 and the third header pipe 3 are arranged in parallel and adjacent to each other, and the second header pipe 2 and the fourth header pipe 4 are arranged in parallel and adjacent to each other. On the whole, the first header pipe 1 and the third header pipe 3 are located at one side of the heat exchanger 100 (which is an upper side of the figure in this embodiment), and the second header pipe 2 and the fourth header pipe 4 are located at the other side of the heat exchanger 100 (which is a lower side of the figure in this embodiment).

Referring to FIGS. 9 and 10, arrows in the figures indicate flow directions of the refrigerant. In the embodiment shown in figures of the present application, flow of the refrigerant in the heat exchanger 100 substantially includes four flow paths.

In a first flow path, the refrigerant enters into the first space 11 of the first header pipe 1 from the refrigerant inlet 13, and due to the separation of the first baffle 10, most of the refrigerant flows along corresponding flat tubes 5 to the second header pipe 2 in the direction indicated by the downward arrows.

It should be noted that, in the embodiment shown in the figures of the present application, the first baffle 10 is provided with through holes 101 functioning as the communicating passage, thus a small part of refrigerant passes through the communicating passage in the direction indicated by the rightward arrow and directly enters into the second space 12 of the first header pipe 1. Of course, in the embodiments using the communicating pipe, a small part of refrigerant may directly enter into the second space 12 along the communicating pipe.

In a second flow path, the refrigerant entering into the second header pipe 2 flows along corresponding flat tubes 5 to the second space 12 of the first header pipe 1 in the direction indicated by the upward arrows.

In a third flow path, due to the communication between the second space 12 of the first header pipe 1 and the third space 31 of the third header pipe 3, and the separation of the second baffle 30, the refrigerant passing through the first header pipe 1 flows along corresponding flat tubes 5 and enters into the fourth header pipe 4 in the direction indicated by the downward arrows.

In a fourth flow path, the refrigerant entering into the fourth header pipe 4 flows along corresponding flat tubes 5 to the fourth space 32 of the third header pipe 3 in the direction indicated by the upward arrows, and finally is discharged via the refrigerant outlet 14.

Of course, in other embodiments, the second baffle 30 may not be provided, and the refrigerant outlet 14 is provided on the fourth header pipe 4. In this case, in the third flow path, the refrigerant flows from the third header pipe 3 to the fourth header pipe 4 and is discharged via the refrigerant outlet 14, and there is no fourth flow path.

It can be appreciated that, in the first flow path of the present application, a small part of the refrigerant directly enters into the second space 12 of the first header pipe 1 through the communicating passage, skipping the first flow path and the second flow path, thus the flow quantity of the refrigerant in the first flow path and the second flow path is decreased and the flow resistance is greatly decreased. However, with a lot of research, experiments and creative efforts, the applicant has found that heat transfer capacities of these two flow paths are mainly limited by air state parameters, therefore the decrease of the flow quantity of the refrigerant did not have a great impact on the heat exchange performance.

Besides, the flow quantity of the refrigerant in the third flow path and the fourth flow path is constant, however the fluid state parameters may change, and the flow resistance is increased slightly as the dryness or temperature decreases. With a lot of research, experiments and creative efforts, the applicant has found that heat exchange performance of the third flow path is mainly limited by relevant fluid state parameters of the refrigerant, thus the change of the fluid state parameters may significantly increase the heat exchange capacity of the third flow path as well as the heat exchange capacity of the fourth flow path. It should be noted that, in an embodiment without the fourth flow path, it is only required to consider the improvement of the heat exchange capacity of the third flow path, and there is no need to consider the heat exchange capacity of the fourth flow path.

Figure 11:
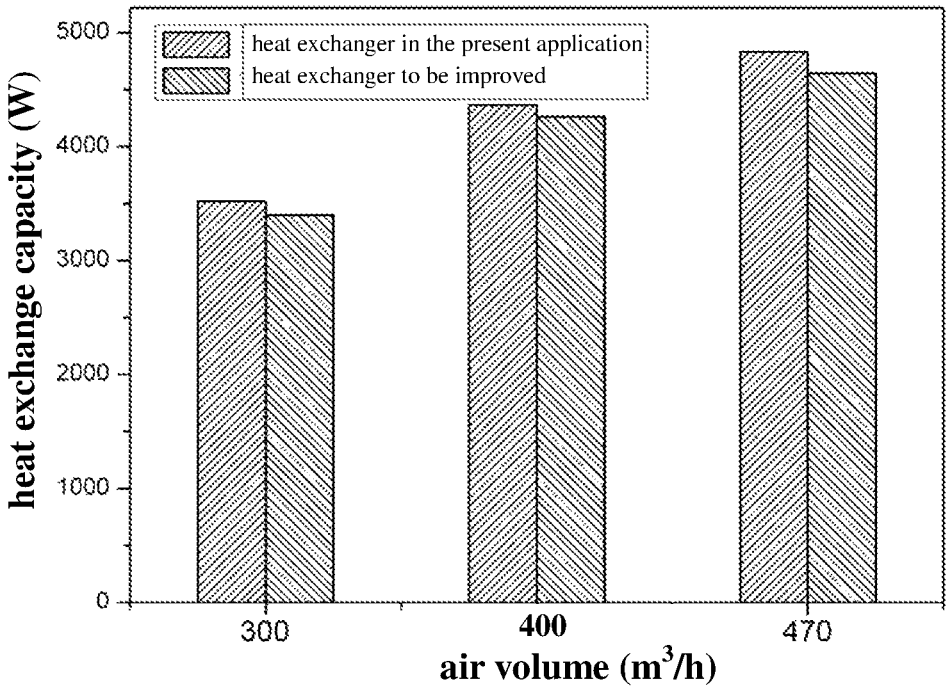
FIG. 11 is a comparison diagram of the heat exchange efficiencies of the heat exchanger according to the present application and the heat exchanger in FIG. 1.

In conclusion, in the present application, by providing the communicating passage, a small part of refrigerant skips the first flow path and the second flow path, and although it appears that the heat exchange performance may be reduced since this part of refrigerant did not participated in heat exchange. Indeed, the experiments show that the heat exchange performance may be reduced slightly, however since the heat exchange capacities of these two flow paths are mainly limited by the air state parameters, the decrease of the flow quantity of the refrigerant did not have a great impact on the heat exchange performance. However, at the same time, since the small part of the refrigerant skips the first flow path and the second flow path, the flow quantity of the refrigerant in the first flow path and the second flow path is decreased, and the flow resistance is greatly reduced. Besides, the above change may change the fluid state parameters of the refrigerant in the third flow path and the fourth flow path, and such change may greatly increase the heat exchange capacity of the third flow path and may also increase the heat exchange capacity of the fourth flow path. That is, the increment of the heat exchange performance in the third flow path and the fourth flow path is greater than the loss of the heat exchange performance in the first flow path and the second flow path, therefore, on the whole, with the design of the present application, the overall heat exchange performance of the heat exchanger 100 can be improved (which can refer to the comparison diagram shown in FIG. 11). Besides, the decrease of the refrigerant in the first flow path and the second flow path is greater than the increase of the refrigerant in the third flow path and the fourth flow path, therefore, the overall flow resistance of the heat exchanger 100 may be decreased to some extent. The heat exchanger can be used as an evaporator in a system or as a cooling device in a system without an evaporator.

In the conventional technology, the heat exchange performance is simply equated with the refrigerant participating in the heat exchange, which is not the most scientific view. The present application overcomes this technique prejudice in the conventional technology, and as shown by the results, even though a part of the refrigerant has not participated in the heat exchange of a certain flow path, the heat exchange performance of the heat exchanger can also be improved on the whole.

It should be noted that, the above embodiments are only intended for describing the present application, and should not be interpreted as limitation to the technical solutions of the present application. Although the present application is described in detail in conjunction with the above embodiments, it should be understood by the person skilled in the art that, modifications or equivalent substitutions may also be made to the present application by the person skilled in the art; and any technical solutions and improvements thereof without departing from the spirit and scope of the present application fall into the scope of the present application defined by the claims.

The invention claimed is:

1. A heat exchanger, comprising a refrigerant inlet, a refrigerant outlet, a first header pipe, a second header pipe, a third header pipe, a fourth header pipe and a plurality of flat tubes, one part of the flat tubes connecting the first header pipe to the second header pipe, another part of the flat tubes connecting the third header pipe to the fourth header pipe, wherein the first header pipe comprises a first baffle comprising at least two through holes and separating the first header pipe into a first space and a second space, one of the at least two through holes is located at a center of the first baffle, and the first space and the second space are in direct communication with each other via the at least two through holes, the refrigerant inlet is directly arranged on the first header pipe and in direct communication with the first space of the first header pipe, and the second space of the first header pipe is in communication with the third header pipe, wherein a flow path, that the refrigerant entering via the refrigerant inlet flows from the first space of the first header pipe to the second header pipe along corresponding flat tubes, is defined as a first flow path; a flow path, that the refrigerant flows from the second header pipe to the second space of the first header pipe along corresponding flat tubes, is defined as a second flow path; and a flow path, that the refrigerant has already passed through the second space of the first header pipe flows from the third header pipe to the fourth header pipe along corresponding flat tubes, is defined as a third flow path; and when the refrigerant flows from the first space of the first header pipe to the second header pipe along the corresponding flat tubes, a part of the refrigerant passes through the at least two through holes in the first baffle to enter into the second space of the first header pipe, to skip the first flow path and the second flow path and directly proceed to the third flow path, to reduce a flow quantity of the refrigerant in the first flow path and the second flow path and keep a flow quantity of the refrigerant in the third flow path constant; and wherein, the second header pipe and the fourth header pipe are both not provided with any baffle and are not in direct communication with each other.

2. A heat exchanger, comprising a refrigerant inlet, a refrigerant outlet, a first header pipe, a second header pipe, a third header pipe, a fourth header pipe and a plurality of flat tubes comprising a first set of flat tubes and a second set of flat tubes, the first set of flat tubes connecting the first header pipe to the second header pipe, the second set of flat tubes connecting the third header pipe to the fourth header pipe, wherein, the first header pipe comprises a first baffle comprising at least two through holes and separating the first header pipe into a first space and a second space, one of the at least two through holes is located at a center of the first baffle, and the first space and the second space are in direct communication with each other via the at least two through holes, wherein the refrigerant inlet is directly arranged on the first header pipe and in direct communication with the first space of the first header pipe, the first space is further in communication with the second header pipe through a part of the first set of flat tubes, the second header pipe being in communication with the second space of the first header pipe through another part of the first set of flat tubes, and the second space of the first header pipe is in communication with the third header pipe, and when refrigerant entering via the refrigerant inlet flows from the first space of the first header pipe to the second header pipe along the corresponding part of the first set of flat tubes, a part of the refrigerant passes through the at least two through holes in the first baffle to enter into the second space of the first header pipe, to skip a first flow path from the first space of the first header pipe to the second header pipe and a second flow path from the second header pipe to the second space of the first header pipe and directly proceed to a third flow path from the third header pipe to the fourth header pipe, to reduce a flow quantity of the refrigerant in the first flow path and the second flow path and keep a flow quantity of the refrigerant in the third flow path constant; and wherein the second header pipe and the fourth header pipe are both not provided with any baffle and are not in direct communication with each other.

3. The heat exchanger according to claim 1, wherein most of the refrigerant is configured to pass through the first flow path and the second flow path to enter into the second space of the first header pipe, and a small part of the refrigerant passes through the at least two through holes in the first baffle and directly enters into the second space of the first header pipe.

4. The heat exchanger according to claim 2, wherein the third header pipe is provided with a second baffle to separate the third header pipe into a third space and a fourth space which are not in direct communication with each other, and the second space is in communication with the third space; and the refrigerant outlet is in communication with the fourth space.

5. The heat exchanger according to claim 1, wherein the third header pipe is provided with an imperforate baffle to separate the third header pipe into a third space and a fourth space which are not in direct communication with each other, and the second space is in communication with the third space; and the refrigerant outlet is in communication with the fourth space; a flow path, that the refrigerant enters into the third space from the second space and flows to the fourth header pipe along corresponding flat tubes, is defined as the third flow path; and a flow path, that the refrigerant flows from the fourth header pipe to the fourth space of the third header pipe along corresponding flat tubes, is defined as a fourth flow path.

6. The heat exchanger according to claim 1, wherein each of the flat tubes is a micro-channel flat tube, and the heat exchanger comprises fins welded between every two adjacent flat tubes.

7. The heat exchanger according to claim 2, wherein most of the refrigerant is configured to pass through the first flow path and the second flow path to enter into the second space of the first header pipe, and a small part of the refrigerant passes through the at least two through holes in the first baffle and directly enters into the second space of the first header pipe.

8. The heat exchanger according to claim 2, wherein each of the flat tubes is a micro-channel flat tube, and the heat exchanger comprises fins welded between every two adjacent flat tubes.

9. The heat exchanger according to claim 2, wherein the heat exchanger is used as an evaporator or a cooling device, the third header pipe is provided with a second baffle to separate the third header pipe into a third space and a fourth space which are not in direct communication with each other, and the second space is in communication with the third space; and the refrigerant outlet is in communication with the fourth space.

10. The heat exchanger according to claim 1, wherein the heat exchanger is used as an evaporator or a cooling device, the third header pipe is provided with a second baffle without a through hole to separate the third header pipe into a third space and a fourth space which are not in direct communication with each other, and the second space is in communication with the third space; and the refrigerant outlet is in communication with the fourth space; a flow path, that the refrigerant enters into the third space from the second space and flows to the fourth header pipe along corresponding flat tubes, is defined as the third flow path; and a flow path, that the refrigerant flows from the fourth header pipe to the fourth space of the third header pipe along corresponding flat tubes, is defined as a fourth flow path.

* * * * *